US006681025B2

(12) United States Patent
Maekawa

(10) Patent No.: US 6,681,025 B2
(45) Date of Patent: Jan. 20, 2004

(54) ELECTROMECHANICAL AND ELECTROACOUSTIC TRANSDUCER

(75) Inventor: Koji Maekawa, Tendo (JP)

(73) Assignees: Pioneer Corporation, Tendo (JP); Tohoku Pioneer Corporation, Yamagata-ken (JP)

( * ) Notice: Subject to any disclaimer, the term of this patent is extended or adjusted under 35 U.S.C. 154(b) by 140 days.

(21) Appl. No.: 10/067,538

(22) Filed: Feb. 7, 2002

(65) Prior Publication Data

US 2002/0114487 A1 Aug. 22, 2002

(30) Foreign Application Priority Data

Feb. 9, 2001 (JP) ..... 2001-033472

(51) Int. Cl.[7] ..... H04R 25/00

(52) U.S. Cl. ..... 381/396; 381/401; 381/402; 381/412; 340/7.58; 340/7.6; 455/576

(58) Field of Search ..... 381/396, 401, 381/402, 412; 340/7.6, 388.1, 7.58; 455/567

(56) References Cited

U.S. PATENT DOCUMENTS 6,553,125 B2 * 4/2003 Kobayashi et al. ..... 381/396
6,590,991 B1 * 7/2003 Maeda ..... 381/409

FOREIGN PATENT DOCUMENTS

JP 2963917 8/1999

* cited by examiner

*Primary Examiner*—Curtis Kuntz
*Assistant Examiner*—Tuân Dúc Nguyên
(74) *Attorney, Agent, or Firm*—McGinn & Gibb, PLLC

(57) ABSTRACT

An electromechanical and electroacoustic transducer is compact and has a simple drive circuit. Two independent magnetic circuits share a single permanent magnet. A voice coil is placed in one of the magnetic circuits, and a magnetic weight is placed in the other magnetic circuit. A switching element is turned on and off upon movements of the magnetic weight.

20 Claims, 4 Drawing Sheets

ELECTROMECHANICAL AND ELECTROACOUSTIC TRANSDUCER

BACKGROUND OF THE INVENTION

1. Field of the Invention

The present invention relates to an electromechanical and electroacoustic transducer used for a portable terminal to cause the portable terminal to vibrate upon signal reception and to reproduce an acoustic signal.

2. Description of the Related Art

One example of an electromechanical and electroacoustic transducer used for a portable terminal (e.g., cellular phone) is disclosed in Japanese Patent No. 2,963,917. This electromechanical and electroacoustic transducer includes a single vibration system that is actuated with a low frequency signal (i.e., call arrival notification signal) or an audio signal. The call arrival notification signal causes the vibration system to vibrate when the portable terminal receives a call, in order to notify a user of the portable terminal of an incoming call. The audio signal also causes the vibration system to vibrate so as to produce a sound (or to reproduce an acoustic signal). The vibration system therefore has to possess vibration response characteristics which are suitable for both mechanical vibrations and acoustic vibrations. In order to drive the electromechanical and electroacoustic transducer, a vibration circuit is required to produce vibrations upon receiving a call, and a switchover circuit is also required to select one of the audio signal and the incoming call notification signal so as to transmit the selected signal to the electromechanical and electroacoustic transducer.

SUMMARY OF THE INVENTION

An object of the present invention is to provide an electromechanical and electroacoustic transducer having a vibration system which only requires a relatively simple vibration response characteristic and which does not require a complicated drive circuit.

According to one aspect of the present invention, there is provided an electromechanical and electroacoustic transducer comprising a permanent magnet, a yoke member for forming a magnetic circuit together with the permanent magnet, a magnetic gap being formed in the magnetic circuit, a voice coil placed in the magnetic gap, an oscillation plate coupled to the voice coil, a vibration coil adjacent to the permanent magnet, a resilient member for supporting the vibration coil such that the vibration coil can move relative to the yoke member or the yoke member can move relative to the vibration coil, and a switching element connected in series to the vibration coil and turned on and off upon movements of the yoke member relative to the vibration coil. The yoke member moves when the vibration coil is energized. The electromechanical and electroacoustic transducer only includes the single permanent magnet and has a compact structure. The two independent vibration systems share the single permanent magnet. One vibration system is utilized to reproduce an acoustic signal and the other vibration system is utilized to produce physically sensible vibrations. The electromechanical and electroacoustic transducer can be therefore actuated with a simple circuitry.

DETAILED DESCRIPTION OF THE INVENTION

Embodiments of the present invention will be described in reference to the accompanying drawings.

Figure 1A:
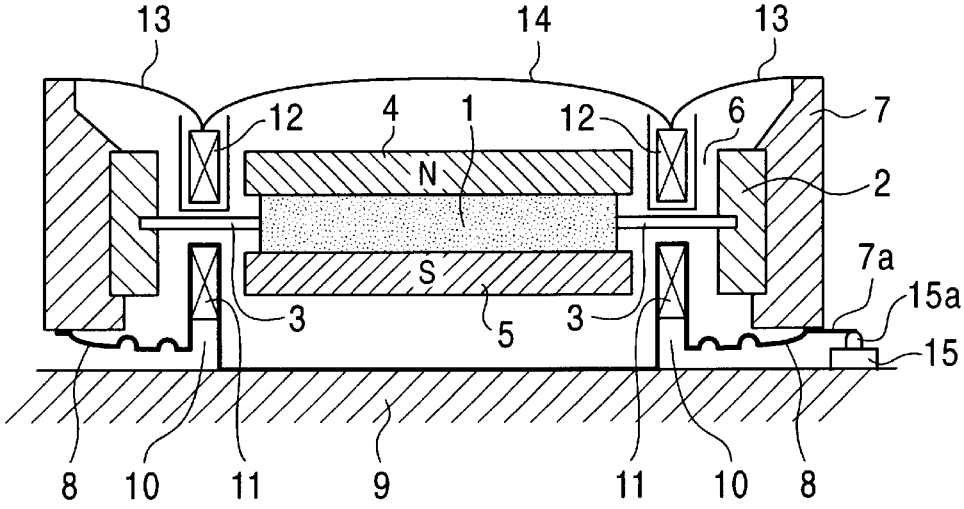
FIG. 1A illustrates a cross sectional view of an electromechanical and electroacoustic transducer according to a first embodiment of the present invention.
Figure 1B:
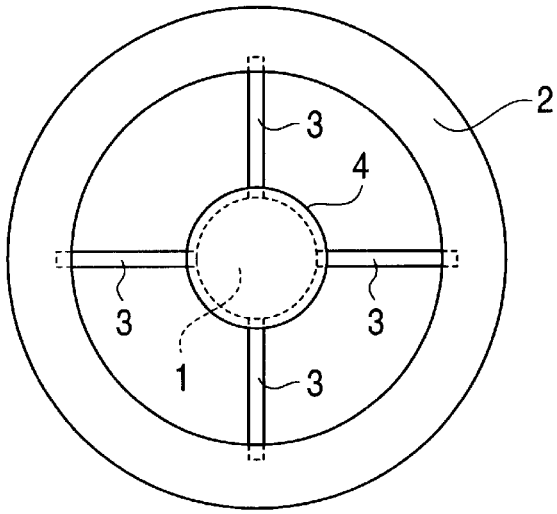
FIG. 1B illustrates a plan view of major parts of the electromechanical and electroacoustic transducer shown in FIG. 1A.

Referring to FIGS. 1A and 1B, illustrated is an electromechanical and electroacoustic transducer according to the present invention, which includes a permanent magnet 1 having a disc or stump shape. The permanent magnet 1 is supported from an annular yoke 2 by a plurality of non-magnetic support rods 3. Opposite magnetic surfaces N and S of the permanent magnet 1 have first and second magnetic plate members 4 and 5 attached thereon, respectively. A magnetic gap 6 is defined between peripheries of the plate members 4 and 5 and an inner peripheral wall of the annular yoke 2. The outer peripheral wall of the annular yoke 2 abuts on an annular non-magnetic support element 7. The support element 7 is supported on a stationary portion 9 of a housing (not shown) by a generally disc-shaped resilient member 8. The resilient member 8 has an annular recess or groove 10 to receive a vibration coil 11. The recess 10 has an inverted "U" cross section as shown in FIG. 1A. The winding direction of the vibration coil 11 is the circumferential direction of the annular recess 10, i.e., a direction which encircles the lower plate member 5. The recess 10 of the resilient member 8 extends into the magnetic gap 6 so that the vibration coil 11 crosses a magnetic flux formed in the magnetic gap 6. A voice coil 12 is connected to an upper edge of the support member 7 via an edge member 13 such that the voice coil 12 can oscillate in an upper space of the magnetic gap 6. A dome-shaped oscillation plate 14 is placed over the voice coil 12. FIG. 1B shows a plan view of the permanent magnet 1 and the support rods 3.

Between the support member 7 and the stationary member 9, a mechanical switch 15 is provided which is maintained to be turned on when the vibration coil 11 is in a non-energized condition. Specifically, a pin 7*a* extending from the support member 7 keeps pressing a projection 15*a* of the mechanical switch 15 as long as the vibration coil 11 is not energized. When a current flows in the vibration coil 11, i.e., when the vibration coil 11 is energized, a repulsive force generated by the vibration coil 11 present in the magnetic flux forces the permanent magnet 1 to move upwards in FIG. 1A. Eventually, the distance between the support member 7 and the stationary member 9 is enlarged, and the pin 7*a* of the support member 7 no longer presses the switch projection 15*a*, whereby the mechanical switch 15 is turned off. It should be noted that an annular support plate may be used instead of the support rods 3 to operatively connect the permanent magnet 1 with the annular yoke 2.

Figure 1C:
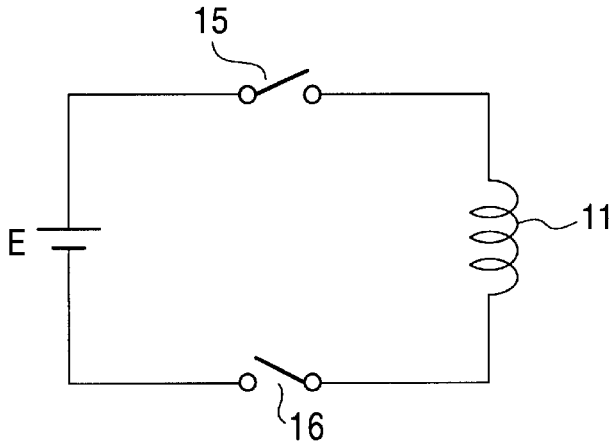
FIG. 1C illustrates a circuit diagram employed in the electromechanical and electroacoustic transducer shown in FIG. 1A.

When the electromechanical and electroacoustic transducer shown in FIG. 1A is employed for a cellular phone, another switch 16 is provided as illustrated in FIG. 1C. The switch 16 is a call arrival detection switch which is turned on upon receiving a call. The switch 16 is connected in series to the mechanical switch 15. The vibration coil 11 is also connected in series to the mechanical switch 15 and the switch 16 so that a DC circuit is formed. A DC voltage E is applied to this DC circuit. If there is an incoming call, an energizing current first flows in the vibration coil 11 and therefore the permanent magnet 1 is lifted to a certain extent. The mechanical switch 15 is then turned off, and the energizing current is no longer supplied to the vibration coil 11. As a result, the permanent magnet 1 descends. Thus, the mechanical switch 15 is turned on again, the energizing current flows in the vibration coil 11 again, and the permanent magnet 1 is lifted again. As the above mentioned series of movements are repeated, the permanent magnet 1, the yoke 2 and the support member 7 are repeatedly moved up and down together. This results in vibrations (shaking) that inform a user of the cellular phone of arrival of the call.

The voice coil 12 is connected to an audio signal supply circuit (not shown) that supplies an audio signal to the voice coil 12. The audio signal is, for example, another call arrival notification signal which acoustically notifies the user of the cellular phone of arrival of the call upon turning on of the call arrival detection switch 16, or a telephone conversation signal. Upon receiving the audio signal, the voice coil 12 vibrates and the audio signal is reproduced from the vibration plate 14 in the form of sound and/or voice.

As understood from the foregoing description, the electromechanical and electroacoustic transducer shown in FIGS. 1A to 1C has two independent vibration systems, but these two vibration systems share the single permanent magnet 1. Therefore, the electromechanical and electroacoustic transducer can be designed to be compact. At the same time, reproduction of the audio signal and production of low frequency vibrations can be carried out with the relatively simple circuitry. The low frequency vibrations are vibrations to notify the call arrival.

It should be noted that the mechanical switch 15 is not limited to the illustrated one. Any suitable switch may be used as the mechanical switch 15 as long as the switch is turned on and off as the permanent magnet 1 (or another element operatively connected to the permanent magnet 1) moves. Further the particular shape of the parts of the electromechanical and electroacoustic transducer shown in FIGS. 1A to 1C are mere examples and the present invention is not limited in this regard.

Figure 2:
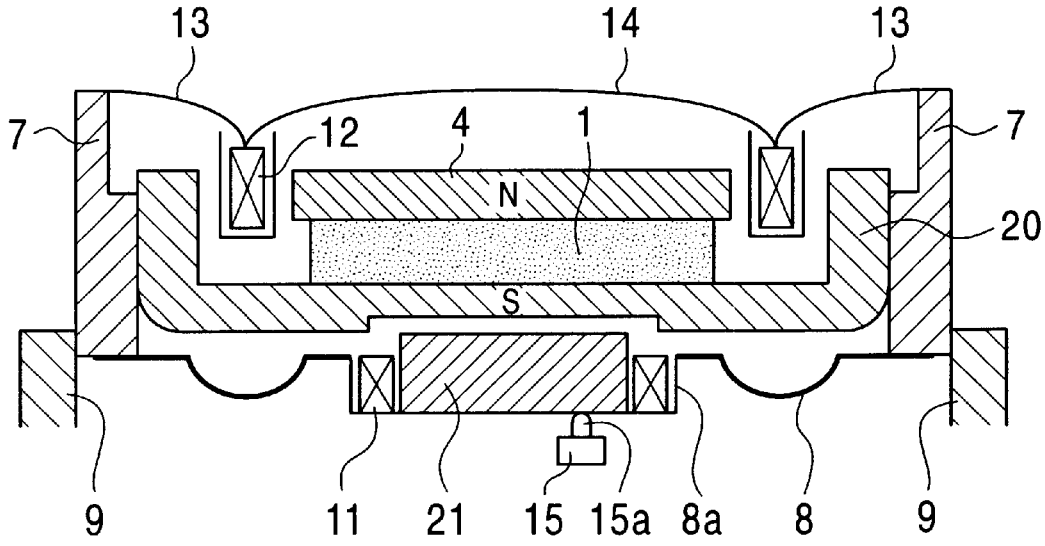
FIG. 2 illustrates a cross sectional view of an electromechanical and electroacoustic transducer according to a second embodiment of the present invention.

FIG. 2 illustrates a second embodiment of the present invention. Like reference numerals are assigned to like elements in the first and second embodiments.

A shallow bowl-like yoke 20 is used in the second embodiment instead of the yoke 2 and the second plate member 5 of the first embodiment. The yoke 20 is a combination of the yoke 2 and the second plate member 5. The non-magnetic support member 7 is secured to the fixed member 9. The vibration coil 11 is received in the annular groove 8*a* formed in the center area of the generally disc-shaped resilient member 8. The annular groove 8*a* has a "U" shaped cross section. The resilient member 8 is secured to a lower end of the support member 7 at the periphery thereof. The inside of the annular groove 8*a* defines the inverted cup-shaped space to accommodate a magnetic weight or body 21. The magnetic weight 21 fixedly fits in the cup-shaped space of the resilient member 8. The mechanical switch 15 is turned on by the magnetic weight 21 when the vibration coil 11 is not energized. In other words, the mechanical switch 15 is located such that the mechanical switch 15 is turned on when the magnetic weight 21 is at a rest position.

Other parts of the electromechanical and electroacoustic transducer, which are not described above, have the same structures as those shown in FIGS. 1A to 1C.

Electric circuits to be connected to the voice coil 12 and the mechanical switch 15 of the electromechanical and electroacoustic transducer shown in FIG. 2 are the same as those employed in the electromechanical and electroacoustic transducer shown in FIGS. 1A to 1C. As the energizing current is intermittently supplied to the vibration coil 11, the magnetic weight 21 is caused to vibrate so as to physically (not acoustically) inform a user of the cellular phone of call arrival. The voice coil 12 is also actuated in the same manner as the first embodiment when the voice coil 12 reproduces an audio signal.

Figure 3:
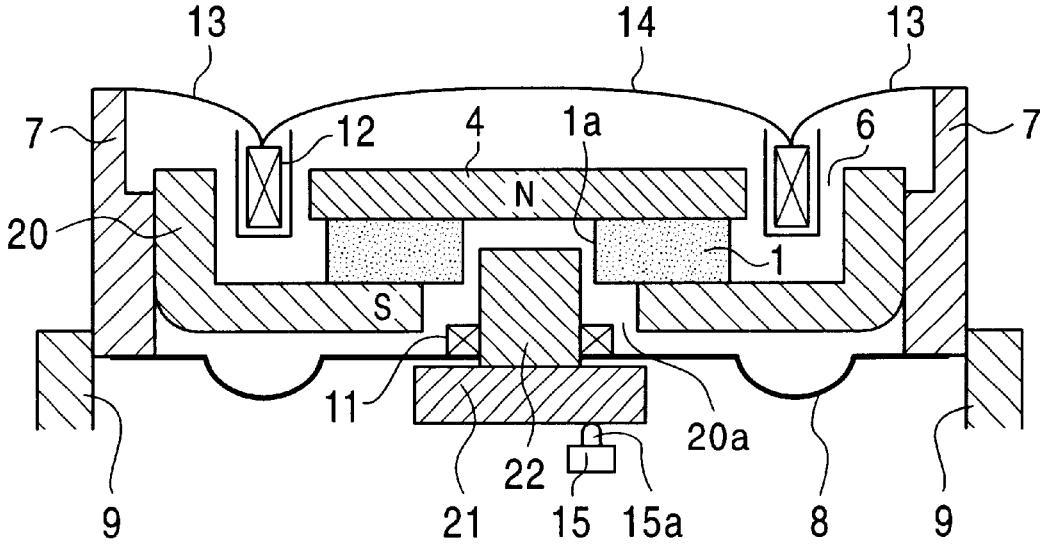
FIG. 3 illustrates a cross sectional view of an electromechanical and electroacoustic transducer according to a third embodiment of the present invention.

FIG. 3 illustrates a third embodiment of the present invention. Like reference numerals are assigned to like elements in the first, second and third embodiments.

The bowl-shaped yoke 20 has a through hole 20*a* at the center of the yoke and the permanent magnet 1 has a through hole 1*a* at the center of the permanent magnet in this embodiment. The center of the through hole 20*a* is substantially coaxial to the center of the through hole 1*a*. A cylindrical core 22 is loosely received in the two through holes 20*a* and 1*a*. The core 22 is placed on an upper surface of a flat center portion of the resilient member 8. The vibration coil 11 is wound around the core 22. The magnetic weight 21 is fixed to a lower surface of the flat center portion of the resilient member 8. Other parts of the electromechanical and electroacoustic transducer, which are not described above, have the same structures as those shown in FIG. 2. Electric circuits to be coupled to the vibration coil 11 and the voice coil 12 are the same as the above described embodiments. As the energizing current is intermittently supplied to the vibration coil 11, the magnetic weight 21 is caused to vibrate so as to inform a user of the cellular phone of call arrival. The voice coil 12 is also actuated in the same manner as the first and second embodiments when the voice coil 12 reproduces an audio signal.

Figure 4A:
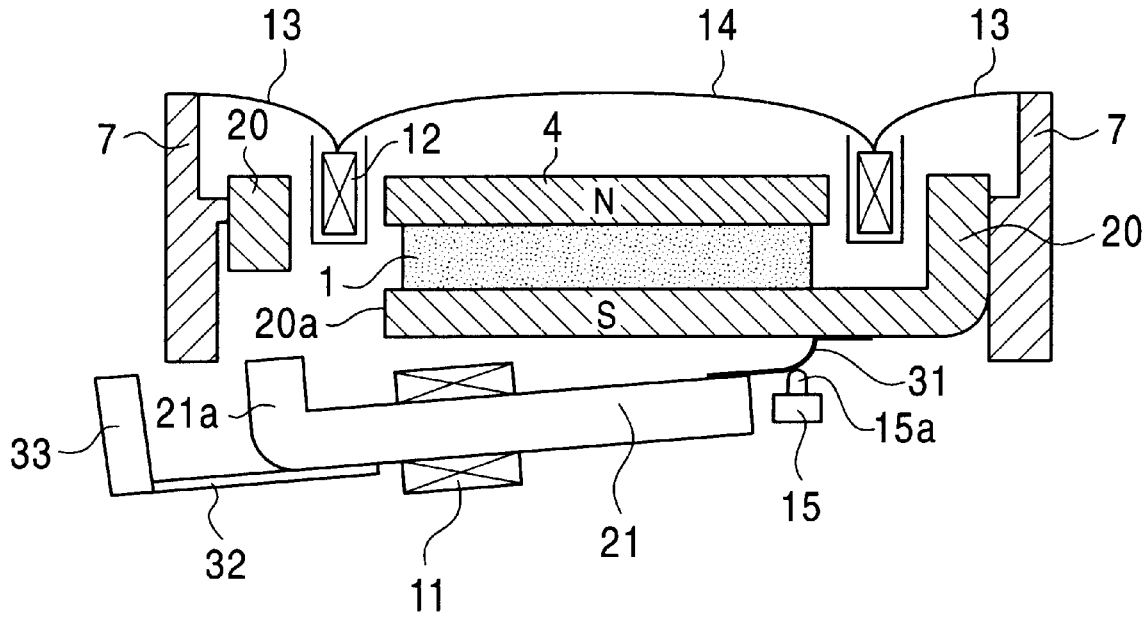
FIG. 4A illustrates a cross sectional view of an electromechanical and electroacoustic transducer according to a fourth embodiment of the present invention.
Figure 4B:
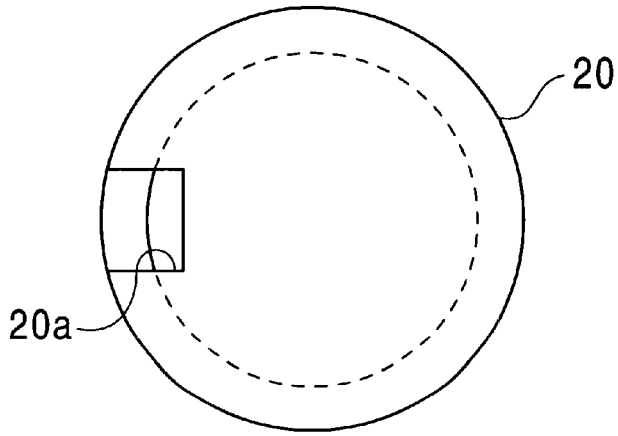
FIG. 4B illustrates a bottom view of a yoke used in the electromechanical and electroacoustic transducer shown in FIG. 4A.

FIGS. 4A and 4B illustrate a fourth embodiment of the present invention. Like reference numerals are assigned to like elements in the first through fourth embodiments.

As shown in FIG. 4A, a through hole 20*a* is formed in the bowl-like yoke 20 near the periphery thereof. The magnetic weight 21 has a general J shape. The bent portion 21*a* of the magnetic weight 21 extends adjacent to the through hole 20*a*. A free end of the main stem portion of the magnetic weight 21 is attached to one end of a resilient plate 31. The other end of the resilient plate 31 is secured to a lower surface of the yoke 20. Therefore, the magnetic weight 21 is supported from the yoke 20 in a cantilever manner. The magnetic weight 21 has a rod shape, and the vibration coil 11 is wound around the center of the magnetic weight 21. When the energizing current flows in the vibration coil 11, the bent portion 21*a* of the magnetic weight 21 is attracted by the permanent magnet 1. The resilient plate 31 contacts the protrusion 15*a* of the mechanical switch 15 when the energizing current does not flow in the vibration coil 11. As the magnetic weight 21 is pulled towards the permanent magnet 1, the resilient plate 31 deforms so that the resilient plate 31 moves apart from the protrusion 15*a* of the mechanical switch 15. This results in turning off of the mechanical switch 15. FIG. 4B illustrates a bottom view of the yoke 20.

A small weight 33 is attached to the magnetic weight 21 via a plate spring 32 at the bent portion of the magnetic weight 21. By appropriately selecting the size (mass) of the weight 33, it is possible to arbitrarily determine a natural frequency of the magnetic weight 21.

Other parts of the electromechanical and electroacoustic transducer have the same structures as those shown in FIG. 2. The electromechanical and electroacoustic transducer operates in the same manner as the second embodiment.

Figure 5A:
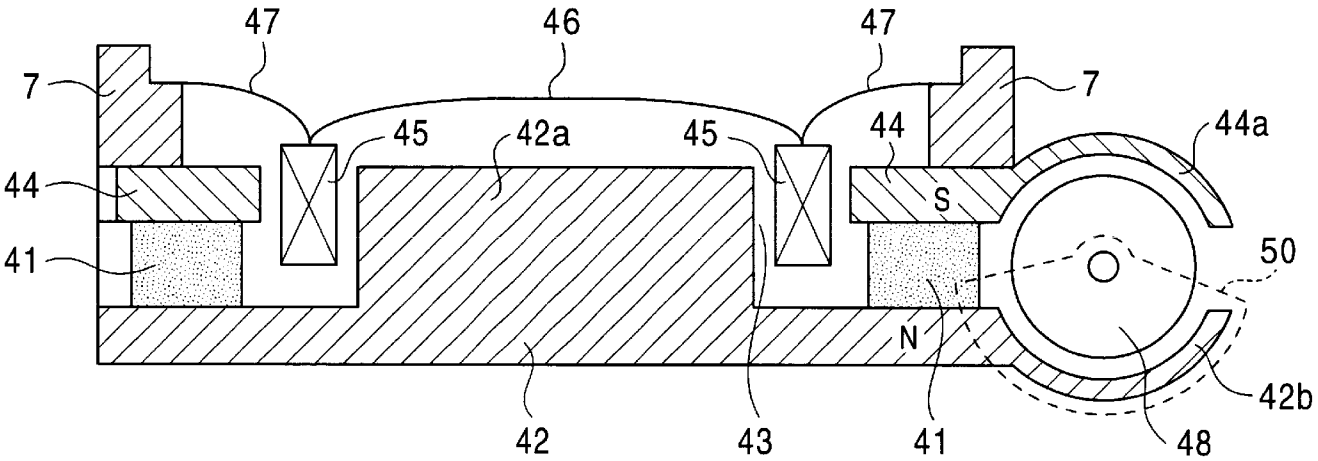
FIG. 5A illustrates a cross sectional view of an electromechanical and electroacoustic transducer according to a fourth embodiment of the present invention.
Figure 5B:
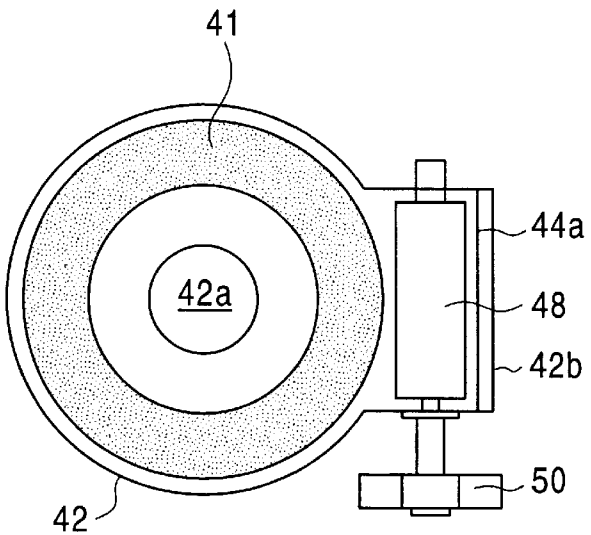
FIG. 5B illustrates a horizontal cross sectional view to show a rotor and associated parts used in the electromechanical and electroacoustic transducer shown in FIG. 5A.
Figure 5C:
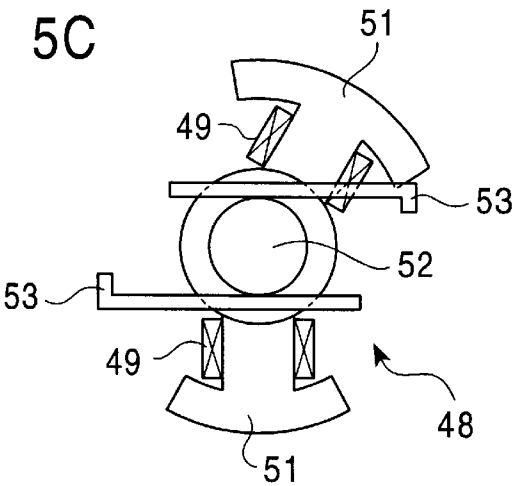
FIG. 5C illustrates a vertical cross sectional view of a DC motor used in the electromechanical and electroacoustic transducer shown in FIG. 5A.

FIGS. 5A to 5C illustrate a fifth embodiment of the present invention. Like reference numerals are assigned to like elements in the first through fifth embodiments.

As illustrated in FIG. 5A, an annular permanent magnet 41 is placed on a generally disc-shaped supporting yoke 42. A center projection 42*a* extends upwards from the center portion of the supporting yoke 42. The annular permanent magnet 41 surrounds the center projection 42*a* of the yoke 42, and a magnetic gap 43 is formed between the permanent magnet 41 and the center projection 42*a*. A generally annular magnetic plate 44 is placed on the annular permanent magnet 41. The space between the magnetic plate 44 and the center projection 42*a* of the yoke 42 also forms the magnetic gap 43. In other words, the position of the magnetic plate 44 elongates the magnetic gap 43 upwards. A voice coil 45 is received in the magnetic gap 43, and a oscillation plate 46 is placed over the voice coil 45. The voice coil 45 is supported from the annular nonmagnetic support body 7 via an annular edge member 47 such that the voice coil 45 can vibrate in the magnetic gap 43.

As illustrated in FIGS. 5A and 5B, a right portion of the periphery of the yoke 42 has an extension, i.e., a half cylindrical element 42*b*. A mating half cylindrical element 44*a* extends from the periphery of the annular magnetic plate member 44. Between these two extensions 42*b* and 44*a*, a rotor 48 is provided that is rotatably supported by bearings (not shown). The rotor 48 has two armature coils 49 (FIG. 5C) and constitutes a DC motor together with the extensions 42*b* and 44*a*.

An eccentric weight 50 is coaxially attached to a rotating shaft of the rotor 48. As depicted in FIG. 5C, the DC motor also has two armatures 51, and each of the armatures 51 has the coil 49 wound therearound. The rotor 48 has a commutator 52 connected to the armature coils 49. Two brushes 53 are provided such that the brushes 53 electrically contact the commutator 52. Accordingly, these parts constitute a double-pole DC motor together with the extensions 42*b* and 44*a* and the permanent magnet 41. A current is supplied to the armatures via a commutating mechanism (i.e., the commutator 52 and the brushes 53) to cause the rotor 48 to rotate.

When the commutating mechanism is connected in series to the call arrival detection switch of the cellular phone and a DC voltage is applied to this DC circuit, the DC motor is activated upon turning on of the call arrival detection switch. Consequently, the rotor 48 rotates and the eccentric weight 50 rotates, thereby generating vibrations (shaking the cellular phone). The vibrations inform the cellular phone user of call arrival.

An audio signal supply circuit is coupled to the voice coil 45. The voice coil 45 vibrates when an audio signal current flows in the voice coil 45. The vibrations of the voice coil 45 cause the oscillation plate 46 to vibrate, thereby producing a sound in accordance with the audio signal.

In this embodiment, the single permanent magnet is shared by the two independent vibration systems. Therefore, the electromechanical and electroacoustic transducer can have a compact structure but is capable of reproducing the audio signal and generating the physically sensible vibrations. Reproduction of the audio signal and generation of the physically sensible vibrations are achieved by connecting the audio signal supply circuit to the voice coil45 and connecting the DC current supply circuit in series to the DC motor.

It should be noted that the present invention is not limited to the described and illustrated embodiments. For example, the mechanical switch 15 may be replaced with any suitable switch such as an optical switch, a magnetic switch or an electrical switch as long as the same switching function is ensured.

This application is based on a Japanese patent application No. 2001-33472, and the entire disclosure thereof is incorporated herein by reference.

What is claimed is:

1. An electromechanical and electroacoustic transducer comprising:

a permanent magnet;

a yoke member forming a magnetic circuit together with the permanent magnet, the magnetic circuit having a magnetic gap;

a voice coil in the magnetic gap;

an oscillation plate coupled to the voice coil;

a vibration coil adjacent to the permanent magnet;

a resilient member supporting the vibration coil such that the vibration coil can move relative to the yoke member or the yoke member can move relative to the vibration coil; and a switching element connected in series to the vibration coil and turned on and off upon movements of the yoke member relative to the vibration coil, the movements of the yoke member being caused when the vibration coil is energized.

2. The electromechanical and electroacoustic transducer according to claim 1 further including a magnetic weight attached to the vibration coil.

3. The electromechanical and electroacoustic transducer according to claim 2, wherein the yoke member includes a first plate member connected to one polarity of the permanent magnet, and a second plate member connected to the other polarity of the permanent magnet.

4. The electromechanical and electroacoustic transducer according to claim 3, wherein the second plate member has a bowl shape, a bottom portion of the bowl shape of the second plate member is connected to the other polarity of the permanent magnet, and a peripheral wall portion of the bowl shape of the second plate member surrounds a periphery of the first plate member to define the magnetic gap.

5. The electromechanical and electroacoustic transducer according to claim 4, wherein the magnetic weight is opposed to the permanent magnet, and the second plate member extends between the magnetic weight and the permanent magnet.

6. The electromechanical and electroacoustic transducer according to claim 4, wherein the second plate member has a through hole in the bottom portion, and a part of the magnetic weight loosely fits in the through hole.

7. The electromechanical and electroacoustic transducer according to claim 6, wherein the permanent magnet has a through hole, and a center of the through hole of the permanent magnet is substantially coaxial to a center of the through hole of the second plate member.

8. The electromechanical and electroacoustic transducer according to claim 1, wherein the switching element is one of a mechanical switch, an optical switch, a magnetic switch and an electric switch.

9. The electromechanical and electroacoustic transducer according to claim 1, wherein the vibration coil is placed in the magnetic gap.

10. An electromechanical and electroacoustic transducer comprising:

a permanent magnet having an annular shape, opposite polarities of the permanent magnet being defined on opposite annular surfaces of the permanent magnet;

a yoke member forming a magnetic circuit together with the permanent magnet, the magnetic circuit having a magnetic gap, the yoke member including a first plate member contacting one polarity of the permanent magnet and a second plate member contacting the other polarity of the permanent magnet, the first plate member having a first half cylindrical portion extending radially outward of the permanent magnet and the second plate member having a second half cylindrical portion opposed to the first cylindrical portion;

a voice coil in the magnetic gap;

an oscillation plate operatively connected to the voice coil;

a pair of vibratable armature coils adjacent to the permanent magnet;

a magnetic rotor member operatively connected to the pair of armature coils and rotatable between the first and second plate members;

a switching element connected to the pair of armature coils and turned on and off upon movements of the rotor member within a magnetic field generated by the permanent magnet, the movements of the rotor member being caused when the pair of armature coils are energized, the switching element including a commutator which rotates with the rotor member, and brushes slidably contacting the commutator; and an eccentric body connected to the rotor member.

11. The electromechanical and electroacoustic transducer according to claim 10, wherein the switching element is one of a mechanical switch, an optical switch, a magnetic switch and an electric switch.

12. An electromechanical and electroacoustic transducer comprising:

a magnet;

a yoke member forming a magnetic circuit together with the magnet, the magnetic circuit having a magnetic gap;

a voice coil in the magnetic gap;

an oscillation plate coupled to the voice coil;

a vibration coil adjacent to the magnet;

a magnetic weight adjacent to the vibration coil such that the magnetic weight moves when the vibration coil is energized;

a resilient member supporting the magnetic weight such that the magnetic weight can move; and a switching element connected in series to the vibration coil and turned on and off upon movements of the magnetic weight.

13. The electromechanical and electroacoustic transducer according to claim 12, wherein the yoke member includes a first plate member connected to one polarity of the magnet, and a second plate member connected to the other polarity of the magnet.

14. The electromechanical and electroacoustic transducer according to claim 13, wherein the second plate member has a bowl shape, a bottom portion of the bowl shape of the second plate member is connected to the other polarity of the magnet, and a peripheral wall portion of the bowl shape of the second plate member surrounds a periphery of the first plate member to define the magnetic gap.

15. The electromechanical and electroacoustic transducer according to claim 14, wherein the magnetic weight is opposed to the magnet, and the second plate member extends between the magnetic weight and the magnet.

16. The electromechanical and electroacoustic transducer according to claim 15, wherein the second plate member has a through hole in the bottom, and a part of the magnetic weight loosely fits in the through hole.

17. The electromechanical and electroacoustic transducer according to claim 16, wherein the magnet has a through hole, and a center of the through hole of the magnet is substantially coaxial to a center of the through hole of the second plate member.

18. The electromechanical and electroacoustic transducer according to claim 15, wherein the magnetic weight has a rod shape, the vibration coil is wound around the rod-shaped magnetic weight, and the yoke member cantilevers the rod-shaped magnetic weight via a resilient member.

19. The electromechanical and electroacoustic transducer according to claim 12, wherein the switching element is one of a mechanical switch, an optical switch, a magnetic switch and an electric switch.

20. The electromechanical and electroacoustic transducer according to claim 13, wherein the magnetic weight has a weight to adjust a natural frequency of the magnetic weight.

* * * * *